US008474210B2

(12) United States Patent
Shapiro

(10) Patent No.: US 8,474,210 B2
(45) Date of Patent: Jul. 2, 2013

(54) DECORATIVE ROOM SURFACE FORMED OF INTERLOCKING DECORATIVE PANELS

(75) Inventor: Gary Shapiro, Bradenton, FL (US)

(73) Assignee: American Metal Ceiling Panel Manufacturer, Bradenton, FL (US)

( * ) Notice: Subject to any disclaimer, the term of this patent is extended or adjusted under 35 U.S.C. 154(b) by 0 days.

(21) Appl. No.: 13/487,398

(22) Filed: Jun. 4, 2012

(65) Prior Publication Data

US 2012/0240507 A1 Sep. 27, 2012

Related U.S. Application Data

(62) Division of application No. 11/165,947, filed on Jun. 24, 2005, now Pat. No. 8,191,326.

(51) Int. Cl.
*E04F 13/076* (2006.01)

(52) U.S. Cl.
USPC ..... 52/506.05; 52/591.1

(58) Field of Classification Search
USPC ..... 52/506.1, 508, 506.01, 506.05, 765, 52/592.1, 589.1, 591.1
See application file for complete search history.

(56) References Cited

U.S. PATENT DOCUMENTS

| | | | | |
|---|---|---|---|---|
| 358,175 | A * | 2/1887 | Thomas | 52/588.1 |
| 460,283 | A * | 9/1891 | Adler | 52/316 |
| 3,559,560 | A * | 2/1971 | Trahan | 248/343 |
| 3,797,190 | A | 3/1974 | Widdowson | |
| 3,936,990 | A | 2/1976 | Garrison, Jr. et al. | |
| 3,950,916 | A | 4/1976 | Kasprzak | |
| 4,047,347 | A | 9/1977 | Scheid | |
| 4,117,642 | A | 10/1978 | Eckert et al. | |
| 4,251,972 | A | 2/1981 | Interlante | |
| 4,413,457 | A | 11/1983 | Lahm et al. | |
| 4,437,287 | A | 3/1984 | Halfaker | |
| 4,480,360 | A | 11/1984 | Brugman et al. | |
| 4,580,382 | A | 4/1986 | Judkins et al. | |
| 4,599,831 | A | 7/1986 | Magaha, Jr. | |
| 4,781,005 | A | 11/1988 | Rijnders | |
| 4,858,409 | A | 8/1989 | Handley et al. | |
| 4,884,383 | A | 12/1989 | Rijnders | |
| 4,951,443 | A | 8/1990 | Caferro | |
| 5,191,743 | A | 3/1993 | Gailey | |
| 5,202,174 | A | 4/1993 | Capaul | |
| 5,253,463 | A | 10/1993 | Witmyer | |
| 5,425,210 | A | 6/1995 | Zafir | |
| 5,428,930 | A | 7/1995 | Bagley et al. | |
| 5,507,125 | A | 4/1996 | McClure | |
| 5,535,566 | A | 7/1996 | Wilson et al. | |
| 5,878,541 | A | 3/1999 | Gruber | |
| D421,897 | S | 3/2000 | Washecheck et al. | |
| 6,079,177 | A | 6/2000 | Halchuck | |
| 6,108,994 | A | 8/2000 | Bodine | |

(Continued)

*Primary Examiner* — Michael Safavi
(74) *Attorney, Agent, or Firm* — Saile Ackerman LLC; Stephen B. Ackerman

(57) ABSTRACT

A decorative panel is manufactured for installation on a surface of a room. The decorative panel is formed from a material that can be shaped having a decorative portion, two female mounting portions and two male portions. The female portions have punched holes for fastening the panels directly to a surface, and the male portions of an adjacent panel are positioned into the female portions to partially hold the adjacent panel and to obscure from view the punched holes and fastening hardware. The panel design and installation method allows the decorative panels to be attached directly to a building material such as sheet rock without any intervening supporting structure.

5 Claims, 5 Drawing Sheets

U.S. PATENT DOCUMENTS 6,155,764 A 12/2000 Russo
6,205,733 B1 3/2001 LaLonde
6,230,463 B1 5/2001 Bodine
6,467,228 B1 10/2002 Wendt et al.
6,499,262 B1 12/2002 Pinchot et al.
7,134,249 B2 11/2006 Shapiro et al.

* cited by examiner

DECORATIVE ROOM SURFACE FORMED OF INTERLOCKING DECORATIVE PANELS

RELATED PATENT APPLICATION

This application is related to U.S. patent application Ser. No. 10/659,633, filed on Sep. 10, 2003, and assigned to the same assignee as the present invention.

This is a Divisional Application of U.S. patent application Ser. No. 11/165,947, filed on Jun. 24, 2005, and incorporated by reference in its entirety, and assigned to the same assignee.

TECHNICAL FIELD

The present invention relates to ceiling panels and in particular to ceiling panels placed over and capable of being attached directly an existing ceiling or wall surface.

BACKGROUND

Many homes and businesses use ceiling panels as a way to add lighting, acoustic absorption and decoration. There are many ways to attach the ceiling panels, but most require a mechanism to be attached to the ceiling or ceiling joists to which the ceiling panels are, or can be, attached. Some application of ceiling tile require plywood or equivalent, strips of wood or metal rails and/or channels, to first be attached to the ceiling, and then the ceiling tile is attached to the strips of wood or the plywood. In other applications a hanger mechanism is attached to the ceiling upon which the ceiling tile is suspended below the original ceiling. These mechanisms add difficulty and expense to the installation of ceiling tile and can define the limits of the design of the tile.

U.S. Pat. No. 3,936,990 (Garrison Jr. deceased et al.) is directed to a suspended ceiling using grid members and interlocking clips. U.S. Pat. No. 3,950,916 (Kasprzak) is directed to a unique clip to support suspension members for ceiling panels. U.S. Pat. No. 4,117,642 (Eckert et al.) is directed to a clip structure to hold together ceiling panels. U.S. Des. 421,897 (Wasecheck et al.) is directed to a ceiling panel hold down clip. U.S. Pat. No. 4,437,287 (Halfaker) is directed to rectangular metal ceiling panels having separated perforate and imperforate faces. U.S. Pat. No. 4,480,360 (Brugman et al.) is directed to a clip for mounting a wall or ceiling panel structure. U.S. Pat. No. 4,580,382 (Judkins et al.) is directed to a ceiling attachment member for attaching flanged ceiling panels. U.S. Pat. No. 4,599,831 (Magaha, Jr.) is directed to a device for securing ceiling panels to a T-bar support. U.S. Pat. No. 4,781,005 (Rijnders) is directed to an adapter for use with a support grid for ceiling elements. U.S. Pat. No. 4,858,409 (Handley et al.) is directed to a support member for supporting ceiling panels along its length. U.S. Pat. No. 4,884,383 (Rijnders) is directed to a support grid for ceiling elements. U.S. Pat. No. 4,951,443 (Caferro) is directed to a panel and clip constriction for attaching ceiling panels. U.S. Pat. No. 5,191,743 (Gailey) is directed to a concealing trim assembly for wall or ceiling panel systems. U.S. Pat. No. 5,202,174 (Capaul) is directed to a ceiling panel structure comprising a glass fiber ply, a gypsum board and a perforated vinyl lamina. U.S. Pat. No. 5,253,463 (Witmyer) is directed to safety mechanisms to prevent kerfed ceiling panels from falling. U.S. Pat. No. 5,428,930 (Bagley et al.) is directed to a concealed suspension ceiling system using a T-bar grid network and butterfly clips. U.S. Pat. No. 5,507,125 (McClure) is directed to plastic ceiling panels mounted in a grid of T-rails. U.S. Pat. No. 5,535,566 (Wilson et al.) is directed to a concealed suspension ceiling system using a T-bar grid network.

U.S. Pat. No. 5,878,541 (Gruber) is directed to a ceiling construction for reinforced concrete ceilings. U.S. Pat. No. 6,079,177 (Halchuck) is directed to a ceiling panel assembly that connects directly to ceiling joists. U.S. Pat. No. 6,108,994 (Bodine) and U.S. Pat. No. 6,230,463 (Bodine) are directed to a suspended ceiling panel that conceals the suspension system. U.S. Pat. No. 6,155,764 (Russo) is directed to a support mechanism for wearing on the torso and for raising into place a ceiling panel such as sheet rock. U.S. Pat. No. 6,208,733 (LaLonde) is directed to a direct mount grid for mounting ceiling panels close to a mounting surface. U.S. Pat. No. 6,467,228 (Wendt et al.) is directed to a hinged ceiling panel. U.S. Pat. No. 6,499,262 (Pinchot et al.) is directed to an acoustical ceiling panel for a suspended ceiling.

Attaching ceiling panels to an existing ceiling can be a time consuming effort to install the necessary structure and hardware by which the panels are attached or suspended below the existing surface of a room. A design and method that would allow panels to be attached directly to a room surface will greatly reduce the installation time and expense. The major problem is that sheet rock forms most existing room surfaces, and sheet rock has a limited capability to support weight. Spreading the attachment technique over the entire ceiling provides a way of using the limited strength of the sheet rock and allows a plurality of decorative ceiling panels to be installed and remain attached without falling to the floor.

SUMMARY

It is an objective of the present invention Is to form a decorative panel of moderate size that can be attached to the surface of a room and interlocked with the adjacent decorative panel to form a contiguous pattern.

It is also an objective of the present invention to form the decorative panel from a sheet of metal.

It is still an objective of the present invention to form a decorative panel from any material that can be shaped to form a panel that is directly attached to the surface of a room and interlocked with additional adjacent decorative panels that are subsequently attached directly to the room surface.

It is also still an objective of the present invention to attach a first decorative panel directly to an original room surface, made of sheet rock ceiling or any other building material forming a flat room surface with screws and obscure the screws from view with adjacent decorative panels that are interlocked with the first panel, hiding the screws from view and subsequently attaching to the original room surface with screws.

It is further an objective of the present invention to first attached the decorative panels in a row along a first edge of a surface and then attach additional decorative panels along a second edge of the surface perpendicular to the first edge interlocking adjacent decorative panels to obscure mounting screws from view and making a contiguous decorative design.

In the present invention a decorative panel is formed from a metal sheet, or any other material that can be subsequently formed, by pressing a design into the material of the sheet. The starting sheet of material is approximately twenty-seven inches square with corners that have been cut off and with holes for screws punched into the sheet along two adjacent edges. These two adjacent edges become female flanges when forming of the metal sheet is complete. The other two adjacent edges form male flanges that will help support the finished decorative panel when the male flange is inserted into the female flange which is mounted on a room surface such as a ceiling.

The corners of the metal sheet are cut at an angle approximately forty-five degrees to allow the flange areas on all four sides located beyond a decorative pattern area to be formed. A decorative pattern is formed in an area at a distance from all four edges of the starting sheet. When using a metal material a decorative pattern is formed by pressing the sheet of metal between a female die, or mold, and a male die, which also begins the formation of the edges that provide two female and two male flanges. The area on the outer extremities of the metal sheet beyond the decorative pattern area are pressed down toward the back side of the decorative panel by the press along the sides of the male die forming an "L" shaped bend. After removal from the die, the outer portion of female flanges are bent back upward hinging at the base of the "L" and forming a "V" shape. In the final flange bend the "V" shaped flange is bent back under the decorative panel, and the "V" is pressed together such that the opening of the "V" becomes narrow and held slightly open by two elongated dimples running the length of female flanges to allow joining to a male flange on an adjacent decorative panel. One leg of the "V" extends beyond the area of the decorative pattern upon which are located the holes that will be used to hold the decorative panel to a ceiling. The flange areas comprise a female and a male flange that are formed on opposite edges of the decorative area where along two adjacent edges of the decorative panel female flanges are formed and along the two remaining adjacent edges male flanges are formed. The female flanges extending beyond the area of the decorative design contain holes for mounting screws. The male flanges extending beyond the area of the decorative design have a smooth surface of the original sheet of material and are inserted into the female flange of an adjacent decorative panel to help hold the panel to which the male flange is attached to the room surface. The female flanges are folded in three folds to form the female flange that comprises a portion under the decorative design area to receive the male flange, and a portion extending beyond the decorative area containing mounting holes for attaching the decorative panel to a room surface. The male flanges are folded in one folding step to produce an "L" shaped male flange that protrudes outward from the decorative area and mates with the female flange of adjacent decorative panels when being attached to a room surface. The male flange slips into the female flange over the heads of the mounting screws holding the panel with the female flange to the room surface and obscuring the mounting screws from view.

The decorative panels are first installed in a first column, running along one edge of an area on the surface of a room with a first panel located at a corner of the area that is to receive the decorative panels, where the female flanges are oriented away from the corner in the direction of the remaining area. Each decorative panel is held in position by six screws, three along each edge of the female flanges. If the original surface is created from a building material called sheet rock, the screws are of a type particularly suited for the sheet rock material. A second decorative panel is positioned adjacent to the first panel in the first column such that a male flange is positioned into the female flange, and the decorative areas of the first and second panel are butted together, obscuring the mounting screws and forming an extended decorative pattern along the first column. Then the second decorative panel is attached to the room surface with six screws, using three mounting holes located in each of the two female flanges of the second decorative panel. Subsequent panels are attached to the room surface in the first column in a similar fashion. The mounting process continues in the first column until the first column is completely populated with the decorative panels.

A first row is formed along a second edge of an area on the surface of a room perpendicular to the first column producing an "L" shape. A third decorative panel is positioned next to the first panel in the first row with a male flange of the third panel positioned into the female flange of the first panel, obscuring the heads of the mounting screws holding the first panel to the room surface. The first and third panels are butted together forming an extended decorative pattern along the first row. Then the third decorative panel is attached to the room surface using six mounting screws, three each in the holes of the two female flanges. Subsequent decorative panels are attached in the first row in a similar fashion, extending the decorative pattern to the end of the first row.

Subsequent columns and rows adjacent to the first column and row are populated with additional decorative panels by mating male and female flanges and fastening each panel to the surface of the room directly with screws. This process of populating the area of a surface of a room with decorative panels continues until a last panel is positioned and fastened to the surface of the room.

BRIEF DESCRIPTION OF THE DRAWINGS

This invention will be described with reference to the accompanying drawings, wherein.

DETAILED DESCRIPTION

Figure 1A:
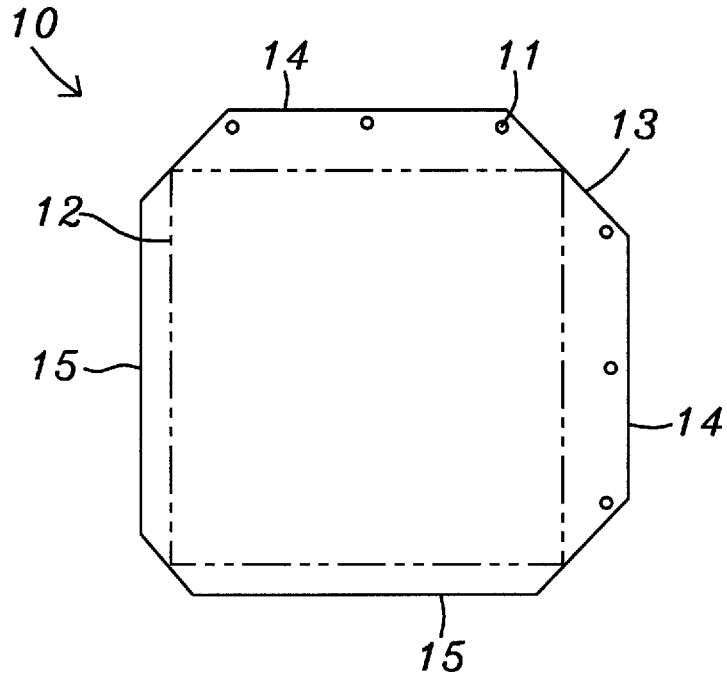
FIG. 1A is a plan view of the present invention showing a prepared sheet of material ready for forming.

In FIG. 1A is shown a sheet 10 of tin-plated alloy steel used to form a decorative panel of the present invention. The sheet measures approximately twenty-seven inches square and contains punched holes 11 on two adjacent sides designated as female sides of the panel. The holes are used in attaching a finished decorative panel to surface of a room. Opposite the female sides are edges designated as male sides 15. Within the sheet is shown an area 12 in which a decorative design is to be formed. The decorative design area is approximately two feet square and offset from the center of the sheet by approximately one half inch in each the "x" and "y" directions. The corners 13 are cut at an angle of approximately forty-five degrees and are positions so that the cut for each corner is tangent to the respective corner of the area 12. The edges 14 containing the punched holes 11 are formed into female flanges that attached the decorative panel to a surface. The edges 15 without holes are formed into male flanges, which mate with female flanges of adjacent decorative panels.

Figure 1B:
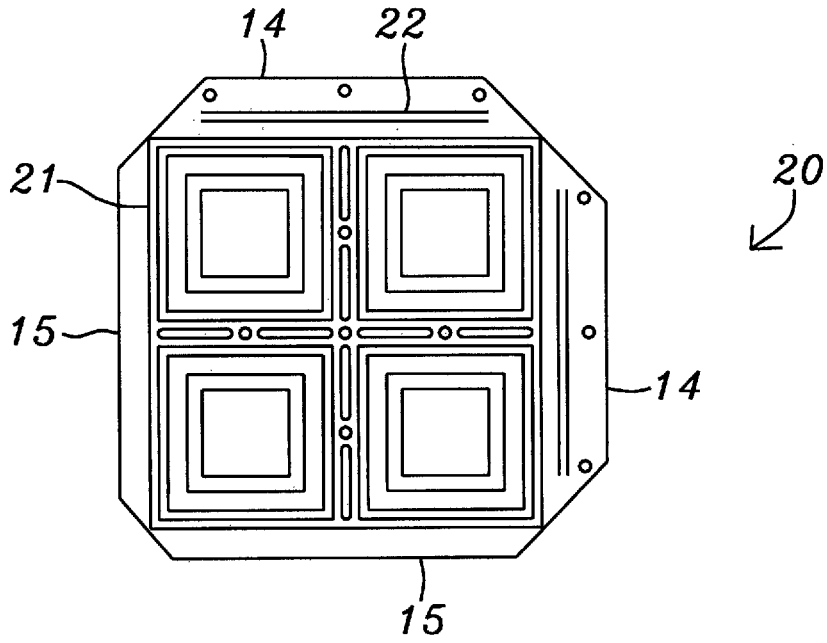
FIG. 1B is a plan view of the present invention of a sheet of material with a pressed design thereon.

In FIG. 1B is shown a sheet of tin plated alloy steel 20 after a decorative pattern 21 has been formed into the sheet using a press with a female die, or mold, and a male die. Two elongated dimples, or protrusions, 22 are formed on the two female sides 14, which contain the punched holes 11. The elongated dimples, or protrusions, are used to allow easy insertion of a male flange of an adjacent decorative panel into a female flange of the completed decorative panel by keeping a folded female flange slightly open. A view of the corner where the two female sides 14 come together is shown in FIG. 2A and a corner view of the joining of the two male sides is shown in FIG. 2B.

Figure 2A:
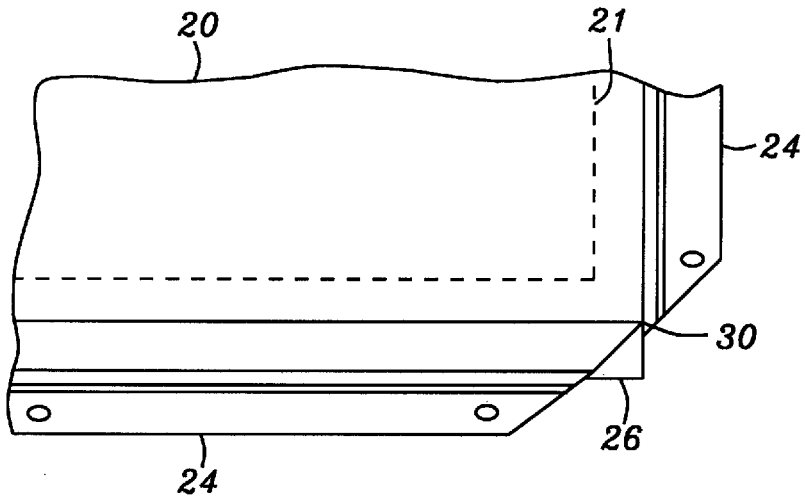
FIG. 2A is an isometric view of the present invention showing the partial formed female edges after a first bending operation.
Figure 2B:
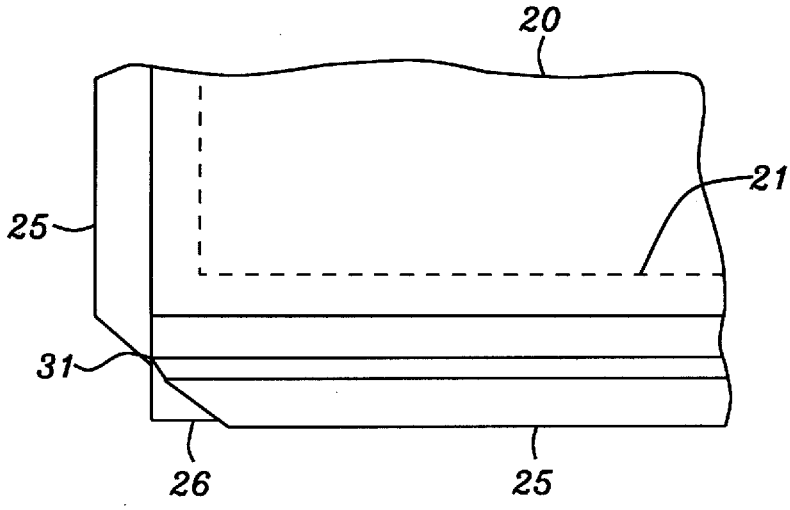
FIG. 2B is an isometric view of the present invention showing the formed male edges.

In FIG. 2A is an isometric view of the corner 30 where the two folded female sides 14 (FIG. 1B) come together after the first fold 24 of the area on the panel that contains the two female edges. In this first fold, the female edges form an "L" shape The sheet 20 containing the formed decorative pattern 21 is shown resting on the male die 26 of the press. In FIG. 2B is shown the corner 31 where the two male sides 15 (FIG. 1B) come together again forming an "L" shaped male flange 25. The vertical leg of the "L" is much shorter than that of the vertical leg for the female edges 24 in FIG. 2A.

Figure 3:
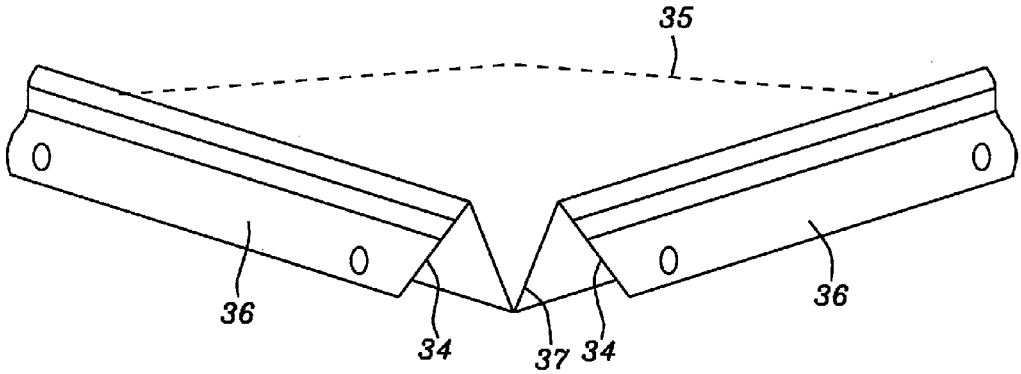
FIG. 3 is an isometric view of the present invention showing the partial formed female edges after a second bending operation.

In FIG. 3 is shown a second fold of the female edges 34 into an inverted "V" shape. Behind the second folded female edges is the area of the backside of the formed decorative pattern 35. The outer leg 36 of the inverted "V" is longer than the inner leg, which will allow the punched holes 11 to be exposed after the final fold so that the holes can be used to mount the finished decorative panel. The area 37 of the fold requires a cutting away of a slight amount of material so that the two female flanges that are formed in the final fold come together properly and are able to receive a mating male flange from adjacent decorative panels when assembled together on a surface of a room, i.e. a ceiling or a wall.

Figure 4A:
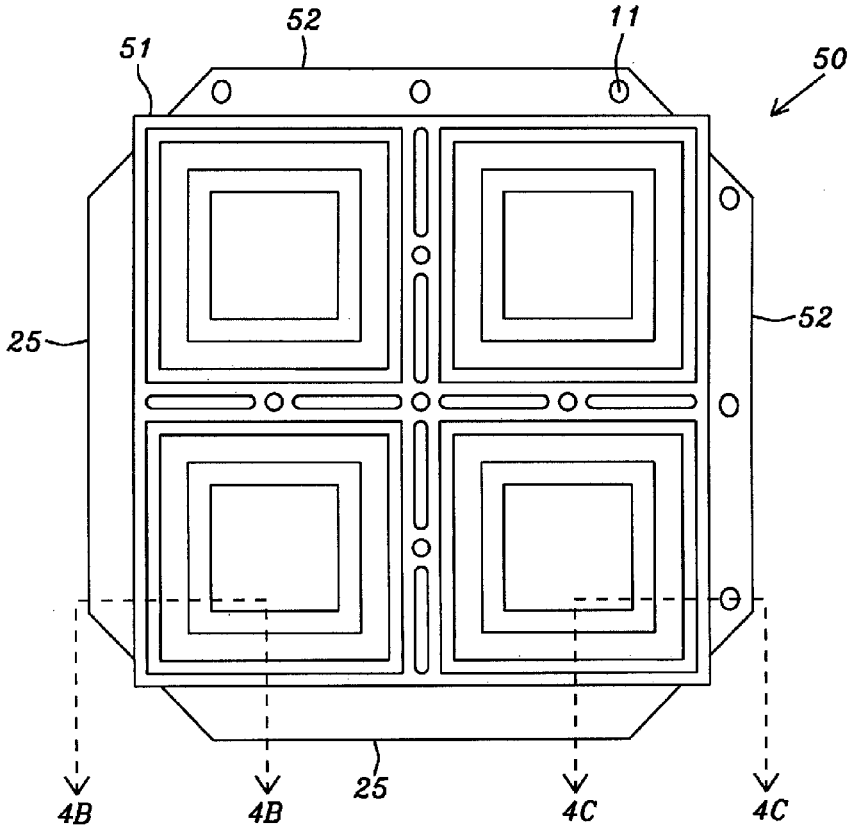
FIG. 4A is a plan view of the present invention showing a formed decorative panel.
Figure 4B:
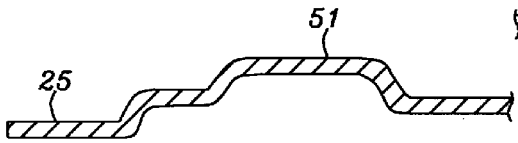
FIG. 4B is a cross section of the formed decorative panel showing an edge containing a male flange.
Figure 4C:
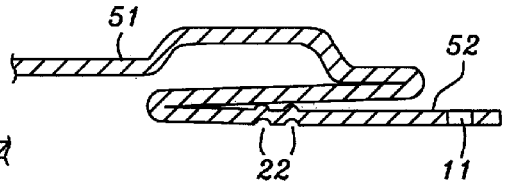
FIG. 4C is a cross section of the formed decorative panel showing an edge containing a female flange.

In FIG. 4A is shown the final formed decorative panel 50. The female sides 52 shown in FIG. 3 as inverted "V" shaped edges 34 are folded under the back of the area containing the decorative pattern 51. The "V" shaped female edges 34 are pressed together creating a narrow opening to receive a male flange 25 (FIG. 2B) and permitting the punched holes 11 to be exposed. In FIG. 4B is shown a cross section of the male flange 25 and a portion of the area of the decorative pattern 51. The vertical edge of the "L" shaped male flange has a length that aligns the foot of the "L" shape with an opening in the female flange 52. FIG. 4C shows a cross section of the final folded and pressed together shape of the female flange 52. A mounting hole 11 is shown in the in the expose leg of the female flange 52 along with the dimples, or protrusions, 22 that extend the length of the flange to keep the female flange slightly open. After the final fold when the mechanical processing of the decorative panel is completed, the panel is coated, for instance by electro static painting, which is heat dried before being assembled together with additional decorative panels on a surface.

Figure 5A:
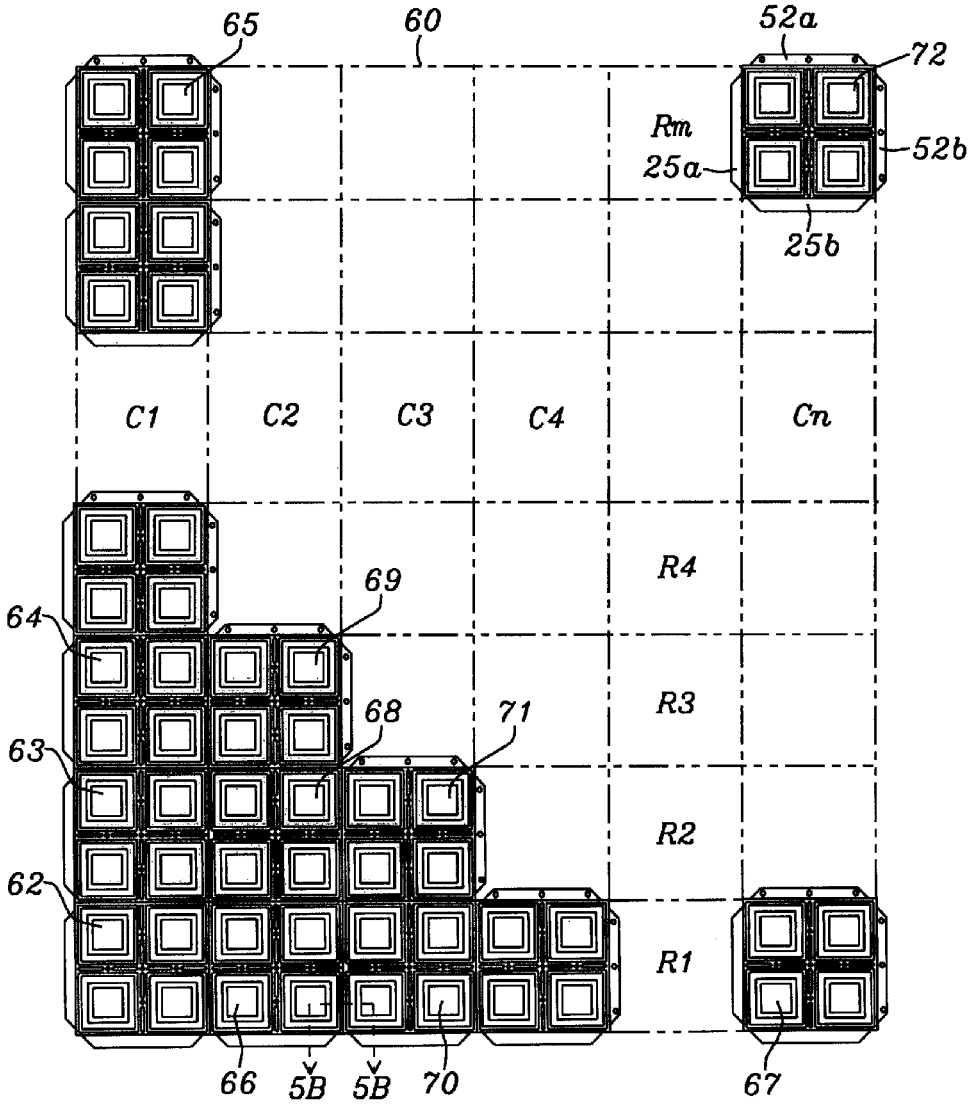
FIG. 5A is a plan view of the present invention showing the population of an area within a room with decorative panels.

In FIG. 5A is a diagram of the present invention showing the mounting of a plurality of decorative panels 72 onto a surface of a room. Each of the panels has a lower male flange 25*b*, a left male flange 25*a*, an upper female flange 52*a* and a right female flange 52*b*. The surface of the room has a grid, either imaginary or laid out by a chalk string, or equivalent, with columns C1 to Cn and rows R1 to Rm. The decorative panels, hereafter called panels, are first positioned, mated with adjacent panel previously installed and connected to a room surface (ceiling or wall) in an "L" shaped pattern starting in a first column C1 and a first row R1 at the outer edge of the area that is to be covered with the panels. Either the first column C1 or the first row R1 can be populated first starting at the corner position, C1 and R1. Any corner of the area can be the starting position, but for purposes of the description herein the starting position is designated as the lower left corner of FIG. 5A.

A first decorative panel 62 is position in the corner formed by column C1 and row R1 with the female flanges pointing towards the area to be populated. Once the first decorative panel is positioned, the panel is fastened to the room surface with screws or other suitable mounting mechanisms. If the surface of the room is made of sheet rock material, then sheet rock screws are used to fasten the panel through the exposed holes in the female flanges. As described herein, each female flange 52*a* and 52*b* has three mounting holes 11; however, there maybe a greater or fewer number of holes needed to be used to attach the panels to a surface, for instance if the surface was a strong material such as wood, then one or two screws or other suitable fastening mechanisms might be used to attach the panels.

Once the first decorative panel 62 has been positioned and fastened to the room surface, a second panel 63 in C1 and R2 is mated with the first panel 62 by aligning the second panel 63 with the first panel 62 and inserting lower male flange of panel 63 into the upper female flange of panel 62 The two panels 62 and 63 are butted together eliminating any discernable gap between the two panels and covering the fastening mechanisms used for panel 62. Panel 63 is then fastened to the material forming the surface in a fashion similar to the first panel 62. The next panel is positioned either above the second panel 63 in C1 or to the right of panel 62 in R1. Herein it is assumed for illustration purposes that the next panel 64 is positioned above panel 63, aligned and mated with panel 63 and mounted to the surface in a similar fashion as described for panel 63 mating with panel 62. The important part of the initial population of the area 60 is to first populate the first column C1 and the first row R1 before any additional columns and rows are populated to allow the mounting holes of each panel to be accessible for fastening a panel to the material forming the surface upon which the panels are being assembled.

The column C1 is populated with additional panels in like fashion as describe for panels 62 and 63 until a final panel 65 is positioned and fastened to the surface. Then panel 66 is position in the first row R1 to the right of panel 62, mated with panel 62 by inserting a left male flange of panel 66 into the right female flange of panel 62, butting the two panels 66 and 62 together to eliminate any discernable gap, covering the fastening mechanisms in the mounting holes in panel 62 and fastening panel 66 to the surface using the punched holes in the two female flanges 52*a* and 52*b* of panel 66. Outer row R1 of the area 69 is populated with additional panels in a similar fashion as used for panel 66, until the final panel 67 in column Cn is positioned and mated with the panel to the left in row R1 and fastened in place.

Continuing to refer to FIG. 5A, next a panel 68 is positioned into column C2 and row R2 where the left male flange 25*b* of panel 68 is inserted into the right female flange 52*b* of panel 63, and the lower male flange 25*a* of panel 68 is inserted into the upper female flange 52*a* of panel 66. Panel 68 is aligned with panels 63 and 66, butting panel 68 against panels 63 and 66 to eliminate any discernable gaps, covering the fastening hardware in panels 63 and 66, and fastening panel 68 to the surface material. Then panel 69 is positioned, aligned and butted against panels 64 and 68, where the left male flange 25*b* of panel 69 is inserted into the right female flange 52*b* of panel 64, and the lower male flange 25*a* of panel 69 is inserted into the upper female flange 52*a* of panel 68. Column C2 is populated with panels using a similar procedure as used for panel 69, and when column C2 is populated row 2 is populated.

Panel 71 is positioned into C3 and R2, aligned, mated and butted against panels 68 and 70, where a left male flange 25*b* of panel 71 is mated with a right female 52*b* of panel 68 and a lower male flange 25*a* of panel 71 is mated with a upper female flange 52*a* of panel 70. Panel 71 is then fastened to the material forming the surface of the area 60. The population of the surface area 60 with panels continues until the last panel 72 in column Cn and row Rm has been position, aligned, and mated with the adjacent panels, and the last panel 72 is fastened to the material forming the surface of the room.

Figure 5B:
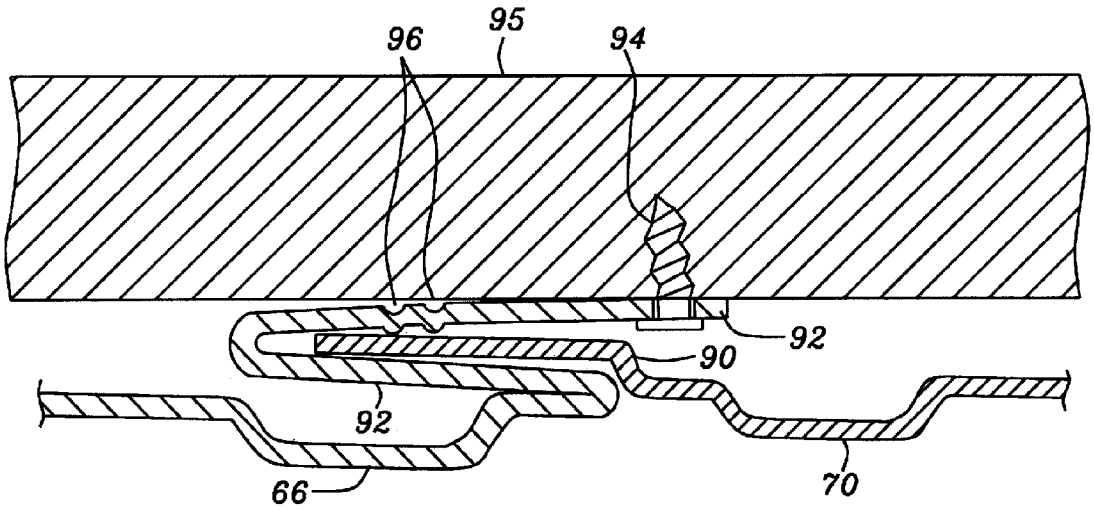
FIG. 5B is a cross section of the present invention showing the mating of a male and female flange and the attachment of the female flange to a surface of a room.

In FIG. 5B is shown a cross section of a mating of a male flange 90 of a panel 70 (FIG. 5A) to a female flange 92 of panel 66. The female flange 92 is fastened to a material 95 forming the surface upon which both panels 66 and 70 are being fastened. Prior to the mating of panels 66 and 70, the female flange 92 of panel 66 is formed into a closed "V" shape where one leg of the "V" longer and is used to allow fastening panel 66 to the building material 95 using a screw in this example. If the material is sheet rock, the screw is a sheet rock screw or equivalent. There are shown two elongated dimples (protrusions) 96, which run the length of the female flange that hold open, slightly, the "V" shape of the female flange to allow the insertion of the male flange 90 formed as part of panel 70. The male flange 90 is formed into an "L" shape and has a smooth surface free of protrusions or perturbations similar to the elongated dimples 96 of the female flange 90.

While the invention has been particularly shown and described with reference to preferred embodiments thereof, it will be understood by those skilled in the art that various changes in form and details may be made without departing from the spirit and scope of the invention.

What is claimed is:

1. A decorative room surface, comprising:
   a) a building material;
   b) a room surface constructed from said building material;
   c) a decorative panel further comprising:
      i) a plurality of male edges located on adjacent edges of said decorative panel; and
      ii) a plurality of female edges located on adjacent edges of said decorative panel not occupied by said male edges;
   d) a plurality of decorative panels organized on said room surface in rows and columns;
   e) a male edge of a first decorative panel of said plurality of decorative panels mated with a female edge of a second decorative panel of said plurality of decorative panels, wherein elongated indentations in a pressed together shape of said female edge of the second decorative panel maintains an opening in said female edge to receive said male edge from said first decorative panel; and
   f) said plurality of decorative panels butted together and attached directly to said room surface using screws that are obscured from view by the male edges of adjoining adjacent decorative panels.

2. The room surface of claim 1, wherein said building material is sheet rock.

3. The room surface of claim 1, wherein said room surface is a ceiling or a wall.

4. The room surface of claim 1, wherein said plurality of decorative panels form a surface containing a decorative pattern.

5. The room surface of claim 4, wherein said female edges of said plurality of decorative panels are connected to said building material with a plurality of screws, and the male edges of the plurality decorative panels are held in place by female edges of adjacent decorative panels.

* * * * *